United States Patent [19]

Pawlak, deceased et al.

[11] 4,132,171

[45] Jan. 2, 1979

[54] APPARATUS FOR DETONATING AN EXPLOSIVE CHARGE

[76] Inventors: Daniel E. Pawlak, deceased, late of Issaquah, Wash., by Cathy J. Pawlak, administrator, 5902-212th Ave. SE., Issaquah, Wash. 98027

[21] Appl. No.: 713,296

[22] Filed: Aug. 10, 1976

Related U.S. Application Data

[63] Continuation-in-part of Ser. No. 520,475, Nov. 4, 1974, abandoned.

[51] Int. Cl.[2] ..... C06C 5/06

[52] U.S. Cl. ..... 102/28 R; 102/27 F

[58] Field of Search ..... 102/28 R, 28 M, 27 R, 102/27 F

[56] References Cited

U.S. PATENT DOCUMENTS

| | | | |
|---|---|---|---|
| 1,086,707 | 2/1914 | Hoagland | 89/1R |
| 3,291,046 | 12/1966 | Dahl | 102/28 R |
| 3,311,056 | 3/1967 | Noddin | 102/28 R |
| 3,371,604 | 3/1968 | Wikner et al. | 102/22 |
| 3,739,724 | 6/1973 | Tlam | 102/28 R |
| 3,878,786 | 4/1975 | Ridgeway | 102/28 R |

FOREIGN PATENT DOCUMENTS

| | | | |
|---|---|---|---|
| 414147 | 8/1934 | United Kingdom | 102/28 M |

*Primary Examiner*—Verlin R. Pendegrass

*Attorney, Agent, or Firm*—Seed, Berry, Vernon & Baynham

[57] ABSTRACT

A detonator having an open-ended metal jacket containing a small explosive charge remotely ignited through a pair of wires extending through one end of the jacket. The explosive charge projects toward one end of the jacket thereby forming an air gap between the explosive charge and the jacket. The air gap absorbs and attenuates the explosive shock so that relatively thin jacket walls are of sufficient strength to withstand detonation of the explosive charge, thereby making the detonator incapable of causing bodily injury. The detonator can be used to ignite a detonating cord by inserting the cord through the open end of the jacket into a jacket cavity until the explosive core of the cord contacts the projecting charge with the casing of the cord occupying the air gap to enclose the explosive charge. Alternatively, the detonator can be used as a conventional blasting cap by arming the cavity with a sufficient quantity of explosive material to rupture the jacket after the detonator has been set up to initiate an explosive charge.

During transportation and handling, the cavity in the detonator is always empty and its open end is covered with a plug. The detonator is, therefore, inherently incapable of either causing injury or detonating another explosive charge.

20 Claims, 7 Drawing Figures

FIG. 1
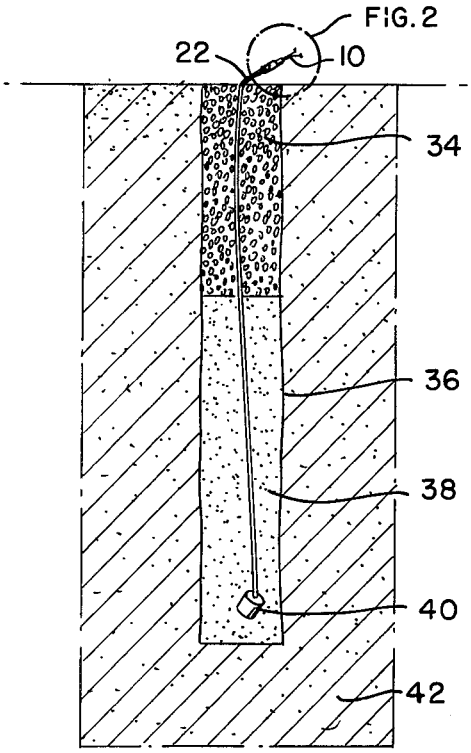
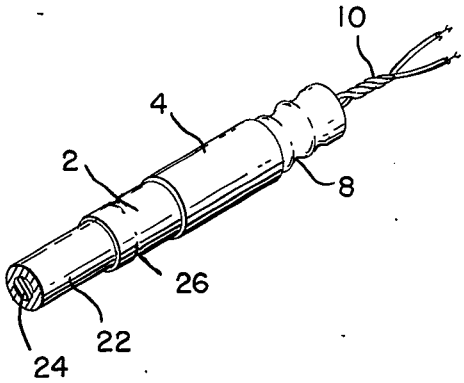
FIG. 2
FIG. 3
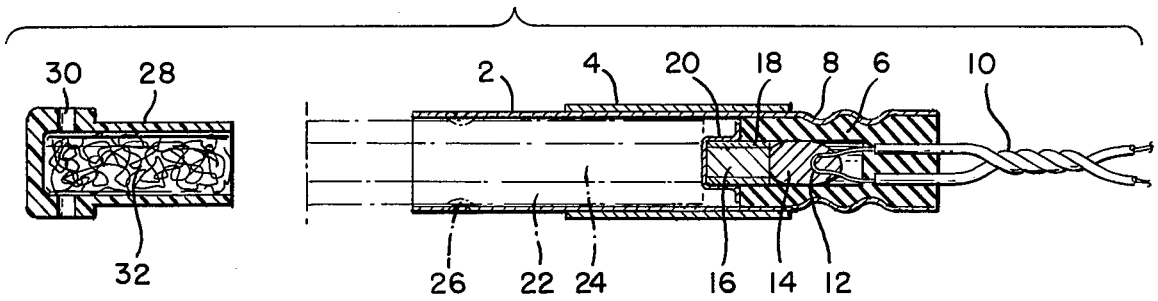

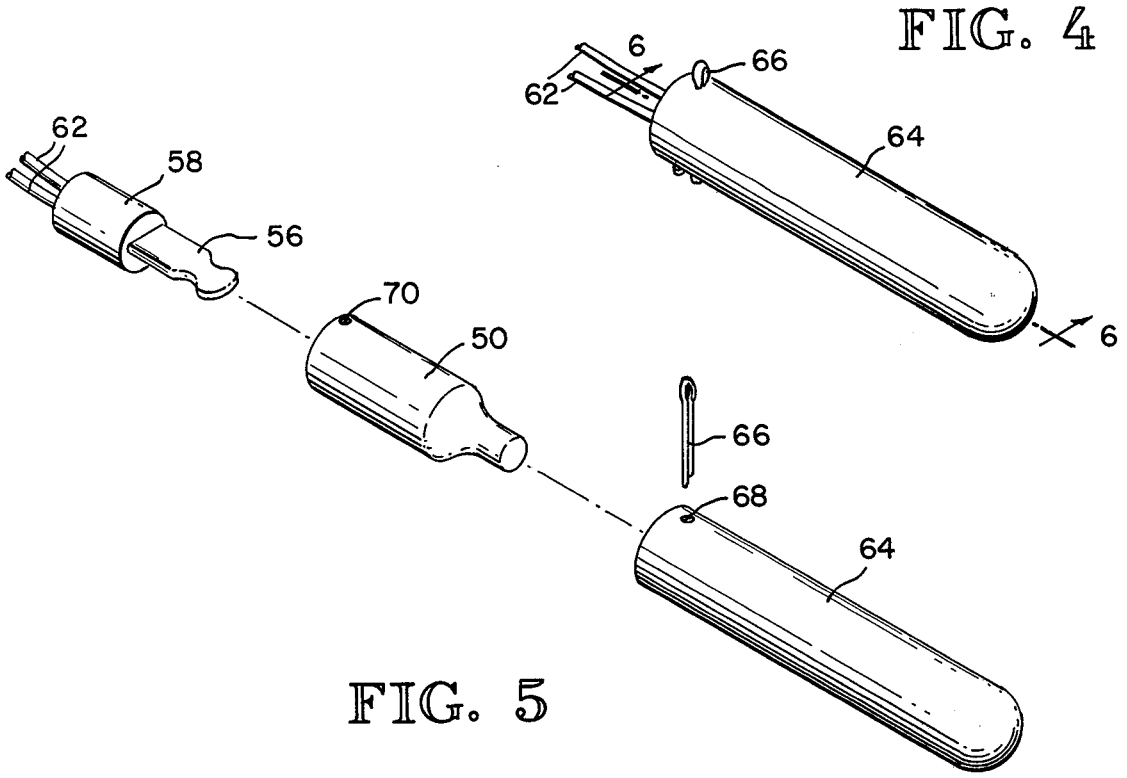
FIG. 4
FIG. 5
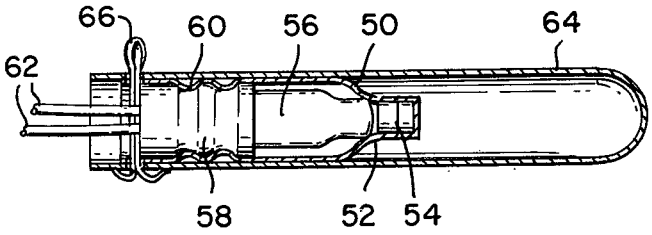
FIG. 6
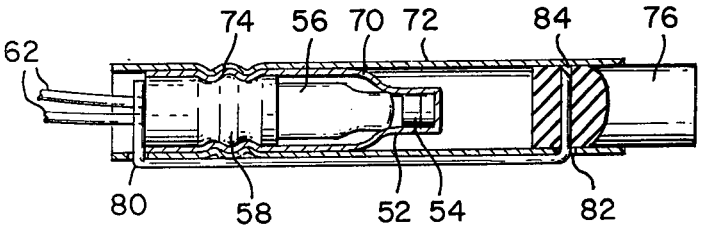
FIG. 7

APPARATUS FOR DETONATING AN EXPLOSIVE CHARGE

CROSS-REFERENCE TO RELATED APPLICATION

This application is a continuation-in-part of application Ser. No. 520,475 filed Nov. 4, 1974, and now abandoned.

BACKGROUND OF THE INVENTION

1. Field of the Invention

This invention relates to detonators for initiating explosive charges and, more particularly, to a detonator which is incapable of causing accidental bodily injury.

2. Description of the Prior Art

All commercial and military explosives require detonators to initiate them. The detonator is fired either by electrical impulse or by a burning fuse in order to generate sufficient heat to initiate the explosives in the detonator. The typical electric detonator consists of an electric bridge wire which heats very rapidly when a current passes through it, surrounded by a bead of pyrotechnic composition which is easily ignited. This bead is in turn coated with or in contact with a small layer of heat sensitive explosive, such as lead axide. The lead azide serves to initiate the main charge of high-strength explosive, which is also contained in the detonator. The main charge, typically PETN or RDX, is relatively insensitive to heat and shock. In the fuse-type detonator, a receptacle for the fuse replaces the two electrical leads and the bridge wire. Detonators measure approximately ¼ inch in diameter and are ½ to 1½ inches long, and have either aluminum or copper jackets.

The very thing that makes detonators useful causes them to be inherently dangerous. They convert a very small amount of input energy into an explosion of sufficient strength to initiate high explosives like dynamite. Detonators can be inadvertently set off by stray electromagnetic fields generated by radio transmitters, by shocks produced by vibrating the detonator or striking it with a hard object, by heat produced by even small fires and by many other types of mishandling. When the detonators explode, the high explosive contained therein is enough to remove a hand or do other serious injury or even cause death.

Attempts to enhance the safety characteristics of detonators have thus far been limited to improved electrical characteristics and changes in composition of the explosive load. Over the years, bridge wires which require a higher current have been adopted, thereby reducing the stray current hazard. Originally, mercury fulminate, a very dangerous material, was used as the heat sensitive explosive and the main charge. However, this explosive combination has now been replaced by lead azide and PETN or RDX combinations, which are less sensitive and thus less dangerous.

One relatively new approach which has increased the safety and reliability of commercial blasting operations has been the use of a detonating cord, such as PRIMACORD, to transfer the shock of a detonator to the main explosive blasting charge. PRIMACORD, a product of the Ensign-Beckford Company, Simsbury, Connecticut, has an explosive core of PETN enclosed by a wrapping of cloth and polyethylene plastic. The detonator is first used to initiate the PRIMACORD, and the explosive blasting charge is detonated when the detonation wave traveling through the PRIMACORD reaches the explosive blasting charge. PRIMACORD can also be used in place of individual electric detonators where a number of explosions are desired. Instead of placing an electric detonator on each explosive charge, a single detonator is used with a length of PRIMACORD extending to each explosive blasting charge. The PETN contained in the PRIMACORD core releases a significant amount of energy when it detonates, yet it is relatively insensitive and, when packaged in PRIMACORD, is virtually immune to accidental initiation by static electricity, stray currents or shocks. It is, therefore, considered by many experts to be safer than extensive networks of electric detonators, and the technique has gained widespread acceptance in the blasting industry.

Even the use of PRIMACORD in blasting operations has not totally eliminated the blasting cap and its inherent hazards, for PRIMACORD must itself be set off with a detonator. Usually, the detonator is taped to the end of the PRIMACORD or a special connector is used. Accidental initiation of the detonator during blasting preparations can cause severe bodily injury and can ignite the PRIMACORD, causing premature detonation of the explosive charge.

SUMMARY OF THE INVENTION

It is an object of the present invention to provide a detonator which is inherently incapable of causing bodily injury.

It is another object of the present invention to provide a detonator which will easily initiate a detonating cord, such as PRIMACORD.

It is a further object of the present invention to provide a detonator which requires less explosives than comparable devices to initiate detonating cord.

It is still another object of the present invention to provide a method of using the inventive detonator as a conventional blasting cap in a manner in which the detonator is incapable of causing bodily injury until the detonator is armed at the blasting site.

These and other objects of the present invention are accomplished by a detonator having a relatively sensitive, remotely ignitable charge enclosed in an open-ended tubular metal jacket. The charge is separated from the jacket walls by an air gap which substantially absorbs and attenuates the explosive shock before reaching the jacket walls. Consequently, relatively thin, and hence inexpensive, jacket walls are of sufficient strength to withstand detonation of the charge, thereby making the detonator inherently incapable of causing bodily injury. A cap normally covers the open end of the jacket during transport or storage to provide further protection in the event of an accidental firing.

The detonator can be used to ignite a detonating cord connected to an explosive charge by inserting the detonating cord into the open end of the jacket. The cord is inserted into the detonator as the final stop before blasting. Thus accidental ignition of the detonator during blasting preparations will not cause injury. The explosive charge within the jacket protrudes toward the open end so that the charge is able to nest within the detonating cord with the explosive charge of the detonator abutting the explosive core of the detonating cord. Consequently, a relatively large percentage of the detonator's explosive shock is transferred to the detonating cord allowing the use of a smaller, and thus safer and less expensive quantity of explosive material in the detonator.

The detonator can also be used as a conventional blasting cap by placing it in close proximity to an explosive charge. The detonator is armed immediately before firing by inserting a sufficient quantity of explosive material into the jacket to rupture the jacket upon detonation and cause a sufficiently strong shock so as to initiate a bulk charge of explosive in which it is in contact or close proximity. Until the detonator has been armed, accidental firing of the detonator will not cause injury since the quantity of explosive in the detonator is insufficient to rupture the detonator jacket. Thus the detonator will not ignite an explosive charge prior to arming even if the explosive charge is in close proximity to the detonator. Alternately, the explosive charge can be removed from within the jacket and placed against the bulk charge.

The detonator of the present invention is inherently safe since the detonator charge, which is relatively sensitive to heat and shock, is isolated from the more powerful, but less sensitive, main charge until immediately before the blast. Since the explosion of the detonator is itself harmless and will not detonate the main charge, an injury-causing, accidental explosion is highly unlikely. A large quantity of detonators and main charges can, therefore, be carried, stored, transported and handled with complete safety.

BRIEF DESCRIPTION OF THE FIGURES OF THE DRAWING

FIG. 1 is a longitudinal cross sectional view of a blast hole illustrating the use of the invention to ignite a length of detonating cord connected to an explosive charge.

FIG. 2 is an isometric view of one embodiment of the inventive detonator as shown in FIG. 1.

FIG. 3 is a cross sectional view of the detonator of FIG. 2 showing the details of construction.

FIG. 4 is an isometric view of an explosive device including a remotely ignited detonating charge stored in a safety case.

FIG. 5 is an exploded isometric view illustrating the manner in which the explosive device of FIG. 4 is assembled.

FIG. 6 is a cross sectional view taken along the line 6—6 of FIG. 4.

FIG. 7 is a cross sectional view of a second embodiment of a detonator for initiating fuse cord.

DESCRIPTION OF THE INVENTION

The detonator of the present invention is shown as used in a typical application in FIG. 1. An explosive booster 40 attached to a length of detonating cord 22 is lowered to the bottom of a blast hole 36 drilled in the formation to be blasted 42. The main charge of blasting agent 24 is poured in stemmed at the top with sand, rock or other suitable material 34. The opposite end of the detonating cord 22 is inserted into the open end of a detonator until the explosive core of the detonating cord 24 abuts the explosive charge of the detonator. The detonator is then initiated, thereby initiating the detonating cord 22. The detonating cord explosion travels down the detonating cord 22 until the booster 40 is reached, at which time the booster 40 explodes, initiating the blasting agent 38 to complete the blasting operation. Until the point where the detonating cord 22 is inserted into the open end of the detonator, an accidental firing of the detonator cannot cause bodily injury. Thus the blasting workers need not worry about electromagnetic fields nor must they treat the detonator with great care during the preparations for blasting.

The detonator can also be used as a conventional blasting cap by attaching the detonator to an explosive charge. As the final step prior to blasting, a short length of PRIMACORD, or other explosive material, is inserted into the open end of the detonator. Until the detonator is armed with a sufficient amount of explosive material to cause jacket rupture, the detonator is incapable of causing bodily injury. Thus preparations for blasting may be performed without exercising a great degree of care of skill until the detonator is armed.

A first embodiment of the present invention is illustrated in FIGS. 2 and 3. A tubular metal jacket 2, preferably of aluminum, forms the shell of the detonator. The jacket 2 encloses a pyrotechnic bead 14 which is ignited by heat generated by a bridge wire 12 inside the bead 14 when current passes through the bridge wire 12. The bridge wire 12 comprises a very thin heating element which is powered by an external electric source through electric leads 10 passing through one end of the detonator. A relatively small charge of lead azide 16, placed in a thin-walled, open-ended container 18, is located adjacent the pyrotechnic bead 14. Since the lead azide is relatively heat sensitive, it will be initiated upon ignition of the pyrotechnic bead 14. A thin metallic cap 20 encloses the lead azide charge 16 to protect the charge from moisture. A major portion of the charge 16 projects from the plug toward the open end of the jacket so that an air gap exists between the jacket 2 and a major portion of the charge 16. Since air is an excellent shock absorber and attenuator a substantial portion of the explosive shock from the charge 16 is absorbed and attenuated before reaching the jacket 2. Consequently, a thiner, and hence less expensive jacket 2 is able to withstand detonation of the charge 16.

One end of the jacket 2 is sealed by a plug 6 of a resilient material, such as rubber, and held in place by crimping the jacket 2 against the plug 6 at 8. A pair of electric leads 10 extend through the plug 6 and are connected across the bridge wire 12. The conductors of the electric leads are typically coated with a waterproof material, such as plastic. The ends of the electric leads are connected to a switchable electric source (not shown) which is used to explode the detonator. The remaining area enclosed by the jacket 2 is empty to form a cavity and, as will be explained hereinafter, is adapted to receive a detonating cord or an explosive charge through the open end of the jacket 2.

A confinement casing 4 is placed around the jacket 2 to enclose the explosive charge of lead azide 16. The strength of the confinement casing 4, in combination with the jacket 2, is sufficient to withstand detonation of the lead azide charge 16. In one operational embodiment of the inventive detonator, the jacket is aluminum and has a diameter of about 0.25 inches and a thickness of 0.02 inches. The confinement casing is also aluminum and has a thickness of 0.05 inches. Overall length is about 1 inch to 1½ inches. The jacket and casing materials can also be copper, steel or other metals. Since accidental initiation of the detonator will not cause jacket rupture, the detonator is incapable of causing injury, even when in direct contact with the human body.

As will be explained hereinafter, the confinement casing 4 and the open-ended container 18 direct the explosion of the lead azide charge 16 in an axial direction. As a result, the reliability and efficiency of the inventive detonator is improved and the required size of the lead azide charge is reduced. The inventive detonator is, therefore, more reliable than prior art devices, as well as more efficient.

During the transportation and handling of the detonator, an end plug 28 covers the open end of the jacket 2. The end plug 28 is fastened to the jacket by inserting the reduced portion of the plug into the open end of the jacket 2 until the end of the jacket abuts the stepped plug wall. The end plug 28 has bored therethrough venting ports 30 which allow exhaust gases produced by detonation of the lead azide charge 16 to escape without forcing the end plug 28 away from the jacket 2 or causing jacket rupture. The center portion of the end plug 28 is filled with energy-absorbing material 32, such as plastic "wool," which absorbs fragments of the cap 20 which are produced by detonation of the lead azide charge 16. In summary, the end plug 28 contains metal fragments produced by detonation of the explosive material contained within the detonator while allowing exhaust gases to vent into the atmosphere.

To use the detonator of the present invention, the leads 10 are connected to a switchable source of electric current. The end plug 28 is then removed from the jacket 2 and either a detonator cord is inserted into the cylindrical jacket 2 of a sufficient quantity of explosive material is inserted through the open end of the jacket 2 to rupture the jacket 2 and confinement casing 4 upon detonation. The detonator is then fired by applying electric current to electric leads 10, causing the bridge wire 12 to instantly heat and ignite the pyrotechnic bead 14, which, in turn, initiates the heat sensitive lead azide charge 16. The heat and shock from the exploding lead axide charge 16 initiate the detonating cord or explosive material that has been inserted through the open end of the jacket 2. The detonator is shown in FIG. 3 as being usd to initiate a detonating cord. The detonating cord, shown in phantom in FIG. 3, comprises a fabric and plastic casing 22 containing an explosive core 24 of PETN or RDX. A commercially available detonating cord embodying this combination is PRIMACORD. The detonating cord 22 is inserted through the open end of the jacket 2 and the explosive core 24 is placed in contact with the projecting lead azide charge 16. Since the lead azide charge 16 projects toward the open end of the jacket 2 the charge 16 nests within the detonating cord so that the casing 22 occupies the air gap by surrounding the charge 16 allowing the charge 16 to directly contact the explosive core 24 of the detonating cord. The direct contact between the charge 16 and core 24, in combination with the tendency of the open-ended container 18 to direct the explosion of the charge 16 in an axial direction causes a relatively large percentage of the explosive force of the charge 16 received by the explosive core 24. Consequently, the quantity of the charge needed to initiate fuse cord can be reduced thereby lowering costs and increasing safety. Furthermore, a smaller charge 16 allows the use of a thinner jacket 2 resulting in additional cost savings. The detonating cord 22 is securely held in place by crimps 26 formed in the jacket 2.

An alternative embodiment of a device for initiating an explosive charge is illustrated in FIGS. 4 and 5. The explosive portion of the device is contained within a casing 50 having a closed, narrow end 52 containing and explosive charge of lead azide 54. An electric match 56 having the bridge wire and pyrotechnic bead construction of the electric matchz of the first embodiment, is positioned within the casing 50 closely adjacent the lead azide charge 54. The electric match 56 projects inwardly from an end plug 58 and is retained within the casing 50 by crimping at 60 (FIG. 6). A pair of leads 62 extend through the plug 58 and contact the bridge wire in the electric match 56.

During transportation and storage, the casing 50 is inserted within a protective jacket 64 and retained by a cotter pin 66 which projects through a pair of aligned bores 68, 70 in the jacket 64 and casing 50, respectively, as best illustrated in FIG. 6.

When the device is to be used to initiate an explosive charge the cotter pin 60 is removed and the casing 50 is withdrawn from the protective jackets 64. The casing 50 is then secured in contact with the explosive charge (not shown) and the leads 62 are connected to an appropriate switchable electric source.

Another embodiment for a detonator for initiating fuse cord is illustrated in FIG. 7. The detonator utilizes an explosive casing 70 substantially identical to the explosive casing 50 of the embodiments of FIGS. 4–6 and, therefore, will not be explained in detail herein. The casing 70 is inserted into an open-ended tubular jacket 72 and retained in position by crimping at 74. A cylindrical, elastomeric plug 76 is inserted into the opposite end of the jacket 72. A retaining wire 78 extends along the length of the jacket 72 with the ends of the wire 78 bent inward and extending through bores 80,82 in the jacket 72 and a through bore 84 in the plug 76 to prevent axial movement of the casing 70 and plug 76 upon accidental detonation of the charge 54. The retaining pin provides initial restraint to prevent the immediate expulsion of the plug 76 upon detonation of the charge 54. As gas pressure within the jacket 72 increases the elastomeric properties of the plug 76 caused it to expand laterally thereby increasing friction between the plug 76 and the inner walls of the jacket 72.

In operation, the retaining pin 78 is removed from the bores 80,82,84 and discarded, the plug 76 is removed from the jacket 72 and a length of fuse cord is inserted into the jacket 72. The beveled end 86 of the jacket 72 facilitates insertion of the fuse cord. Axially pressure is applied to the fuse cord until the projecting end 52 of the casing 70 nests within the fuse cord with the lead azide charge 54 contacting the explosive core of the fuse cord and the fuse cord casing surrounding the air gap. The increased coupling efficiency between the charge 54 and the explosive core of the fuse cord allows a substantially smaller charge 54 to initiate fuse cords. With most prior art detonating devices, a lead azide charge of 50 milligrams is necessary to initiate PETN. With the embodiment illustrated herein a lead azide charge of only 10 milligrams will initiate PETN. The smaller charge 54 allows the use of a thinner casing 70 and jacket 72 to withstand detonation of the charge 54 without the possibility of the detonator causing injury.

The detonating devices of the present invention utilize an air gap which allows the explosive charge contained therein to nest within the explosive core of fuse cord. This increased coupling efficiency allows the use of a smaller, and hence less expensive charge. The reduced charge, coupled with the shock absorbing and attenuating properties of the air gap, allows a thinner jacket to withstand detonation of the charge thereby increasing the safety of the detonator and reducing its cost. Hence, the detonating devices of the present invention are relatively inexpensive and inherently safe to store, transport and handle.

The embodiments of the invention in which a particular property or privilege is claimed are defined as follows:

1. A detonator for initiating fuse cord comprising a tubular jacket adapted to receive said fuse cord at an open end, said jacket enclosing an externally-detonatable explosive charge, said detonator further including isolating means for shock isolating said charge from said jacket such that the shock of said charge exploding is substantially dissipated before reaching said jacket to prevent rupturing the jacket, said isolating means being an air gap surrounding said charge along a substantial portion of the length thereof between said charge and jacket such that explosive shock is substantially dissipated within said air gap.

2. The detonator of claim 1 wherein a resilient end plug extends into said jacket and covers one end thereof, said plug having a central bore receiving a portion of said explosive charge such that said charge projects from said plug into said jacket.

3. The detonator of claim 2 wherein the transverse dimension of said explosive charge is no greater than the transverse dimension of the explosive core of said fuse cord such that said charge nests within the core of said fuse cord when the end of said fuse cord abuts said end plug.

4. The detonator of claim 1 wherein said jacket comprises:

a relatively thin main jacket having walls of a strength insufficient to withstand detonation of said charge; and a confinement casing surrounding the main jacket in the area where said main jacket encloses said explosive charge, said confinement casing having walls of sufficient strength to prevent main jacket rupture upon detonation of said charge.

5. The detonator of claim 1 wherein said open end is covered by a removable end plug having a gas escape port of sufficient size to allow exhaust gases produced by detonating said charge to escape, thereby preventing the exhaust gas from forcing said plug away from the open end of said jacket.

6. The detonator of claim 1 wherein said explosive charge is covered by a metallic cap which protects said explosive charge from moisture, said cap being relatively thin such that the kinetic energy imparted to fragments of said cap upon detonation of said charge may be substantially dissipated within said air gap.

7. The detonator of claim 1 wherein said charge is enclosed by an open-ended, thin-walled container which restrains radial expansion of said charge during detonation so that said charge expands axially into the explosive core of said fuse cord during detonation.

8. The detonator of claim 1 wherein said externally detonable explosive charge is enclosed within a tubular casing mounted inside said jacket, said casing enclosing an electric match and including a relatively thin portion at one end having a diameter substantially smaller than the inside diameter of said jacket surrounding said charge such that said thin portion projects into said jacket toward said open end and is separated therefrom by an air gap which shock isolates said charge from said jacket and allows said charge to nest within the explosive core of a length of fuse cord inserted through the open end of said jacket.

9. The detonator of claim 8 wherein said casing is a unitary tubular shell having walls which taper outwardly from said relatively thin end portion to a body portion having an outside diameter approximately equal to the inside diameter of said jacket.

10. The detonator of claim 9 wherein said electric match projects inwardly from a plug mounted within the body portion of said casing such that said plug seals the interior of said casing and provides a mounting for said electric match.

11. The detonator of claim 8 wherein the open end of said jacket receives an elastomeric plug having initial restraining means for preventing immediate expulsion of said plug responsive to initiation of said charge thereby allowing said plug to compress and forcibly grip the internal walls of said jacket.

12. The detonator of claim 11 wherein said initial restraining means is a restraining wire projected through said jacket into said plug and extending along the length of said jacket toward said casing, said wire projecting through said jacket behind said casing whereby preventing opposed axial movement of said plug and casing responsive to initiation of said charge.

13. The detonator of claim 8 wherein the thickness of said casing along the axial surface of said relatively thin portion is less than the thickness of said cavity along the radial surface of said relatively thin portion such that radial expansion of said charge during detonation is restricted in favor of axial expansion of said charge toward the explosive core of said fuse cord.

14. A detonator for initiating an explosive charge by placing said detonator in contact with said charge, comprising:

a tubular casing enclosing an externally-detonable explosive charge;

a tubular protective jacket removably receiving said casing, the walls of said jacket having a strength sufficient to withstand detonation of said explosive charge without rupture; and isolating means for shock isolating said charge from said jacket such that the shock of said charge exploding is substantially dissipated before reaching the jacket to prevent said charge from rupturing said jacket, said isolating means being an air gap surrounding a substantial portion of said charge between said charge and jacket such that the explosive shock of said charge is substantially dissipated within said air gap.

15. The detonator of claim 14 wherein said casing is a unitary tubular shell having walls which taper outwardly from a relatively thin end portion having a diameter substantially smaller than the inside diameter of said jacket to a body portion having an outside diameter approximately equal to the inside diameter of said jacket.

16. The detonator of claim 15 wherein said casing is removably secured within said jacket by a pin projecting through aligned bores in said shell and casing such that axial movement of said casing from said jacket is prevented by said pin, and said casing may be removed from said jacket by first removing said pin.

17. A detonator for initiating a fuse cord of the type having an explosive core comprising a tubular jacket having an open end adapted to receive said fuse cord, said jacket enclosing an externally-detonatable explosive charge projecting toward said open end from a charge supporting member, said charge having a transverse dimension no greater than the transverse dimension of the explosive core of said fuse cord and a shock isolating air gap surrounding said charge along a substantial portion of the length thereof between said charge and jacket when said charge is placed within said jacket thereby allowing the explosive shock of said charge to be dissipated within said air gap and allowing said charge to nest within said core when the end of said fuse cord abuts said charge-supporting member.

18. The detonator of claim 17 wherein said charge-supporting member is a resilient end plug extending into said jacket, said plug having a central bore receiving a portion of said explosive charge.

19. The detonator of claim 17 wherein said charge-supporting member is a tubular casing having walls which taper outwardly from a relatively thin portion having a diameter substantially less than the inside diameter of said jacket to a body portion having an outside diameter approsimately equal to the inside diameter of said jacket.

20. The detonator of claim 19 wherein said charge is enclosed by an open-ended, thin-walled container which restrains radial expansion of said charge during detonation so that said charge expands axially into the explosive core of said fuse cord during detonation.

* * * * *